US005581239A

United States Patent [19]

Lin

[11] Patent Number: 5,581,239

[45] Date of Patent: Dec. 3, 1996

[54] WAKE-UP DEVICE

[76] Inventor: Lun F. Lin, P.O. Box 82-144, Taipei, Taiwan

[21] Appl. No.: 524,504

[22] Filed: Sep. 7, 1995

[51] Int. Cl.[6] ..... G08B 23/00

[52] U.S. Cl. ..... 340/575; 340/576; 128/782

[58] Field of Search ..... 340/575, 576; 128/272, 782, 644, 733, 774

[56] References Cited

U.S. PATENT DOCUMENTS

| | | | |
|---|---|---|---|
| 2,713,159 | 7/1955 | Morrison | 340/575 |
| 2,754,497 | 7/1956 | Wolpert | 340/575 |
| 3,208,062 | 9/1965 | Gregory | 340/575 |
| 3,906,478 | 9/1975 | Smey | 340/575 |
| 4,272,764 | 6/1981 | Herr et al. | 340/575 |
| 4,359,724 | 11/1982 | Zimmerman et al. | 340/575 |
| 4,836,219 | 6/1989 | Hobson et al. | 340/575 |
| 4,871,998 | 10/1989 | Chaillou | 340/575 |
| 5,488,354 | 1/1996 | Colvin | 340/576 |

*Primary Examiner*—Jeffery Hofsass
*Assistant Examiner*—Benjamin C. Lee
*Attorney, Agent, or Firm*—Alfred Lei

[57] ABSTRACT

A wake-up device including a first flexible headband formed with a battery chamber, a second flexible headband, first oscillating means connected with an end of the first flexible headband, second oscillating means connected with an end of the second flexible headband, a first connector connected with the first oscillating means, a second connector connected with the second oscillating means, wakening means mounted between the first and second connectors, the wakening means including a balance switch, an electronic circuit connected with the balance switch, and a loudspeaker connected with the electronic circuit, whereby when the user feels tired and nods his head, the wakening means will actuate the oscillating means to oscillate and the loudspeaker to produce warning signal.

3 Claims, 7 Drawing Sheets

WAKE-UP DEVICE

BACKGROUND OF THE INVENTION

1. Field of the Invention

This invention relates to a wake-up device which is adapted to fit on one's head.

2. Description of the Prior Art

It has been found that one will easily feel tired and doze off when sitting for a long time. Hence, it will be very dangerous for a driver and the other(s) if he dozes off while driving. Furthermore, many people take stimulents to keep their spirit at the time when they needs to work before desk for a long period of time so that their health is inadvertently hurt.

Therefore, it is an object of the present invention to provide a wake-up device which can prevent the user from dozing without taking stimulents.

SUMMARY OF THE INVENTION

This invention is directed to a wake-up device which is adapted to fit on one's head.

It is the primary object of the present invention to provide a wake-up device which will wake up the user when he feels tired and nods off.

It is another object of the present invention to provide a wake-up device which can be used as a head massager.

It is still another object of the present invention to provide a wake-up device which can be used for preventing a driver to doze while driving.

It is still another object of the present invention to provide a wake-up device which is simple in construction.

It is a further object of the present invention to provide a wake-up device which is easy to use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
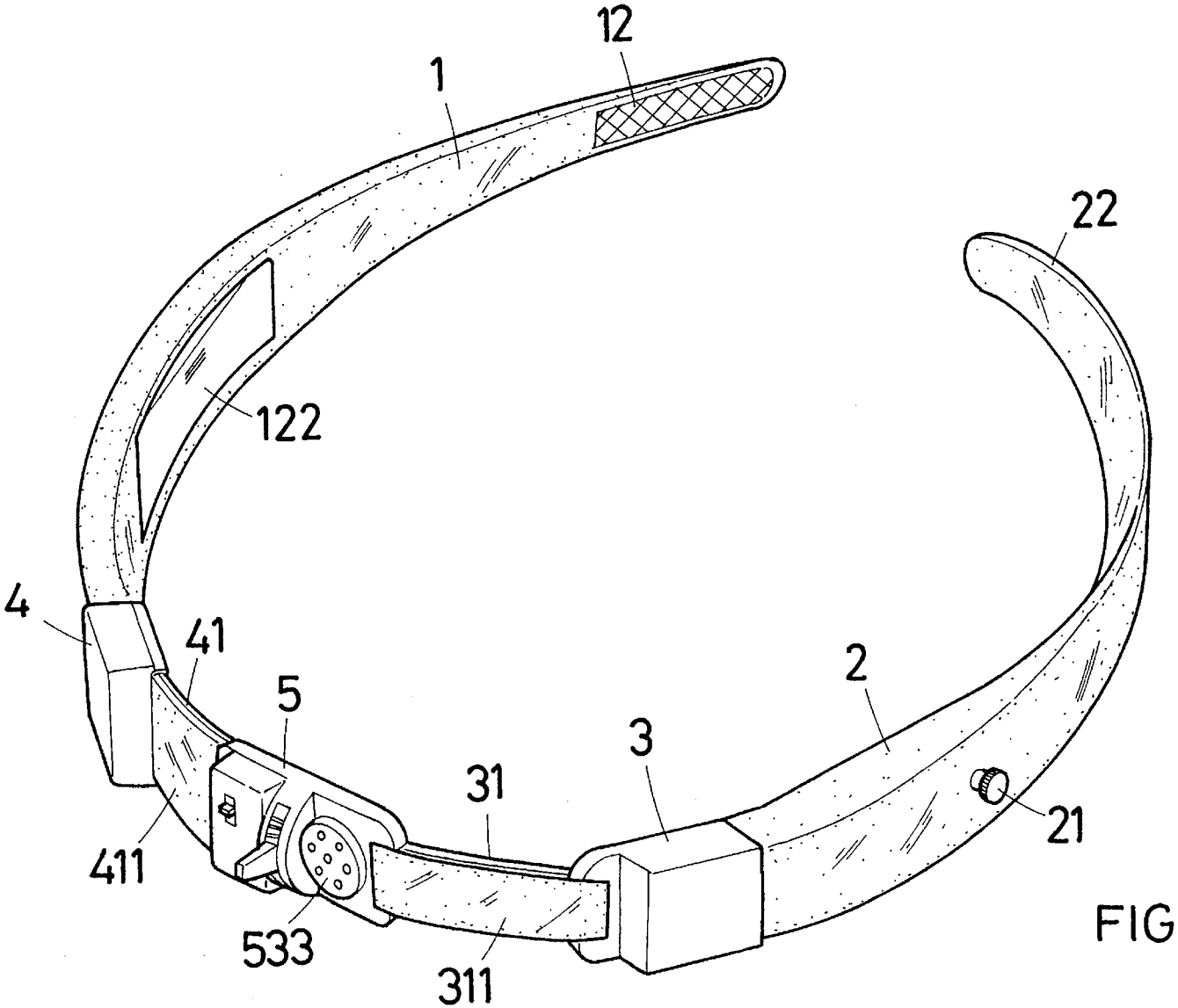
FIG. 1 is a perspective view of the present invention.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
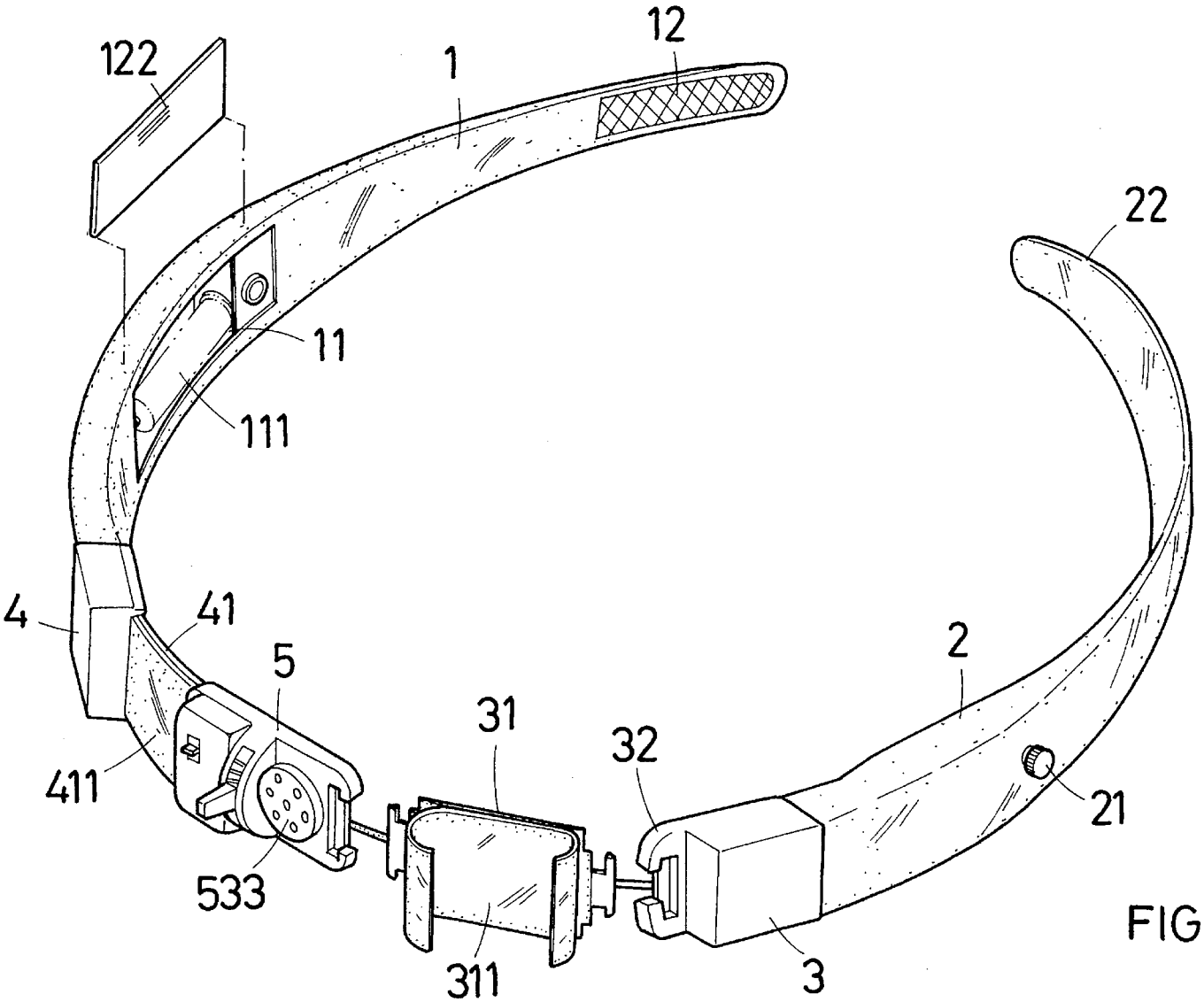
FIG. 2 is an exploded view of the present invention.

With reference to the drawings and in particular to FIGS. 1 and 2 thereof, the wake-up device according to the present invention mainly comprises a first flexible headband section 1, a second flexible headband section 2, a first oscillating device 3, a second oscillating device 4, a first connector 31, a second connector 42, and an wakening device 5.

The first flexible headband section 1 is formed with a chamber 11 for receiving batteries 111. A cover 122 is adapted to engage with the chamber 11. The second flexible headband section 2 is provided with a control switch 21 which is electrically connected with the first and second oscillating devices 3 and 4 for controlling the oscillating intensity thereof. Both the first and second flexible headband sections 1 and 2 are provided at the outer end with a male fastening strip 12 and a female fastening strip 22 respectively. Further, the first and second flexible headband sections 1 and 2 are connected at the inner end with the second and first oscillating devices 4 and 3. The second and first oscillating devices 4 and 3 are respectively provided with decorative coverings 411 and 311. The wakening device 5 is connected between the first and second oscillating devices 3 and 4.

Figure 3:
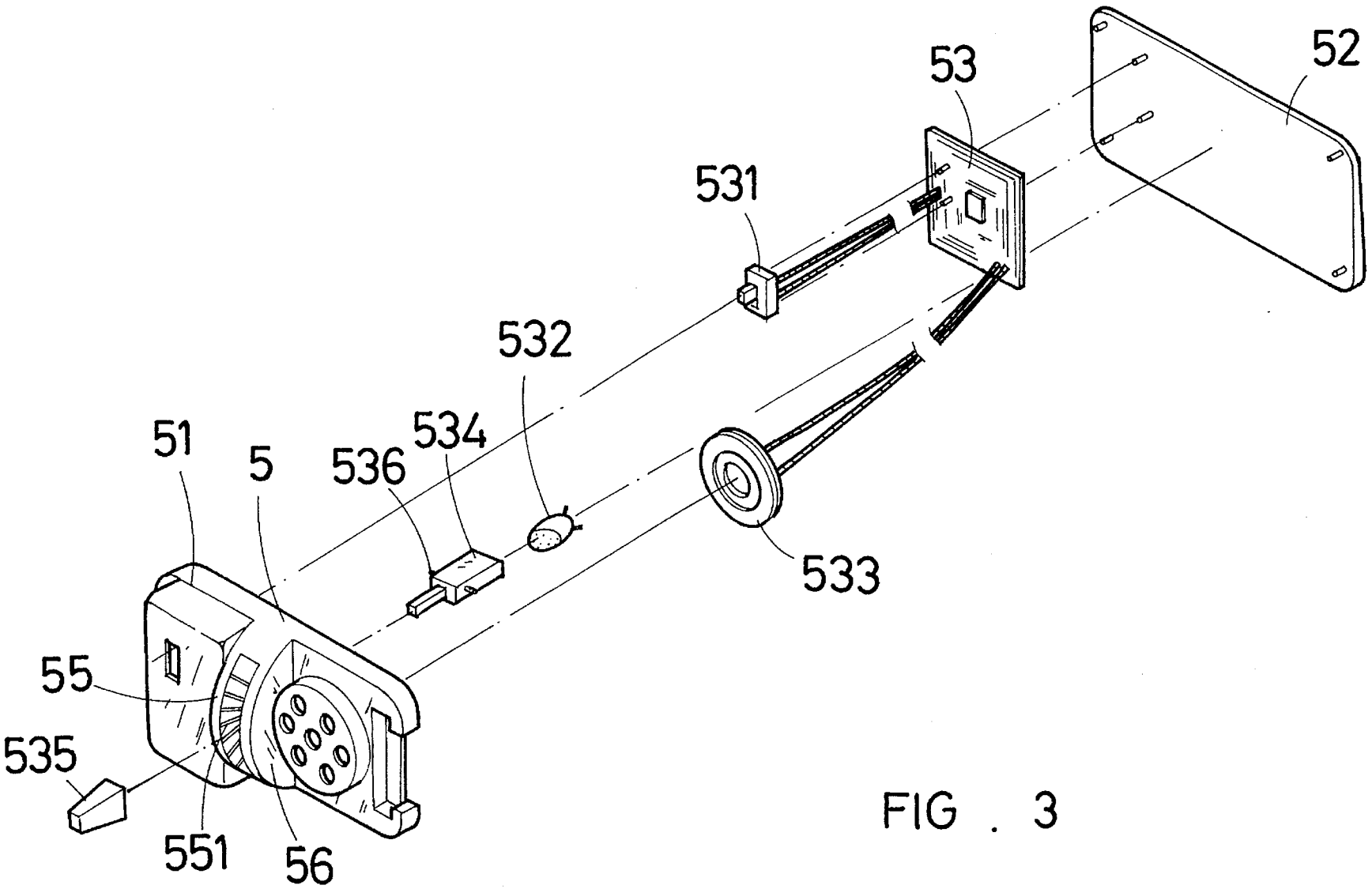
FIG. 3 is an exploded view of the wakening device.

As shown in FIG. 3, the wakening device 5 includes a housing 51 and a bottom plate 52. The housing 51 has a pair of curved plates 55 and 56 each formed with a plurality of ribs 551. Within the housing 51 there are a printed circuit board 53, a selection switch 531, a balance switch 532, and a loudspeaker 533. The balance switch 532 is one which can be set so that it will be turned on when its position is inclined to an angle exceeding a preset value. The balance switch 532 may be of any conventional design well known to those skilled in the art and is not considered a part of the invention. The balance switch 532 is fitted in an adjusting rod 534 provided with a protuberance 536 at both sides. The adjusting rod 534 is inserted between the curved plates 55 and 56, with its protuberances 536 engaged between the ribs 551. A cap 535 is engaged with the outer end of the adjusting rod 534 so that the position of the balance switch 532 can be adjusted by regulating the cap 535. As balance switch 532 is moved so that its inclined angle is larger than the preset value, the printed circuit board 53 will actuate the oscillating devices 3 and 4 and the loudspeaker 533. Further, once the inclined angle of the balance switch 532 exceeds the preset value, the time that the oscillating devices 3 and 4 and the loudspeaker 533 will work is controlled by the printed circuit board 53 and is no longer be effected by time that the balance switch 532 is turned on.

Figure 4:
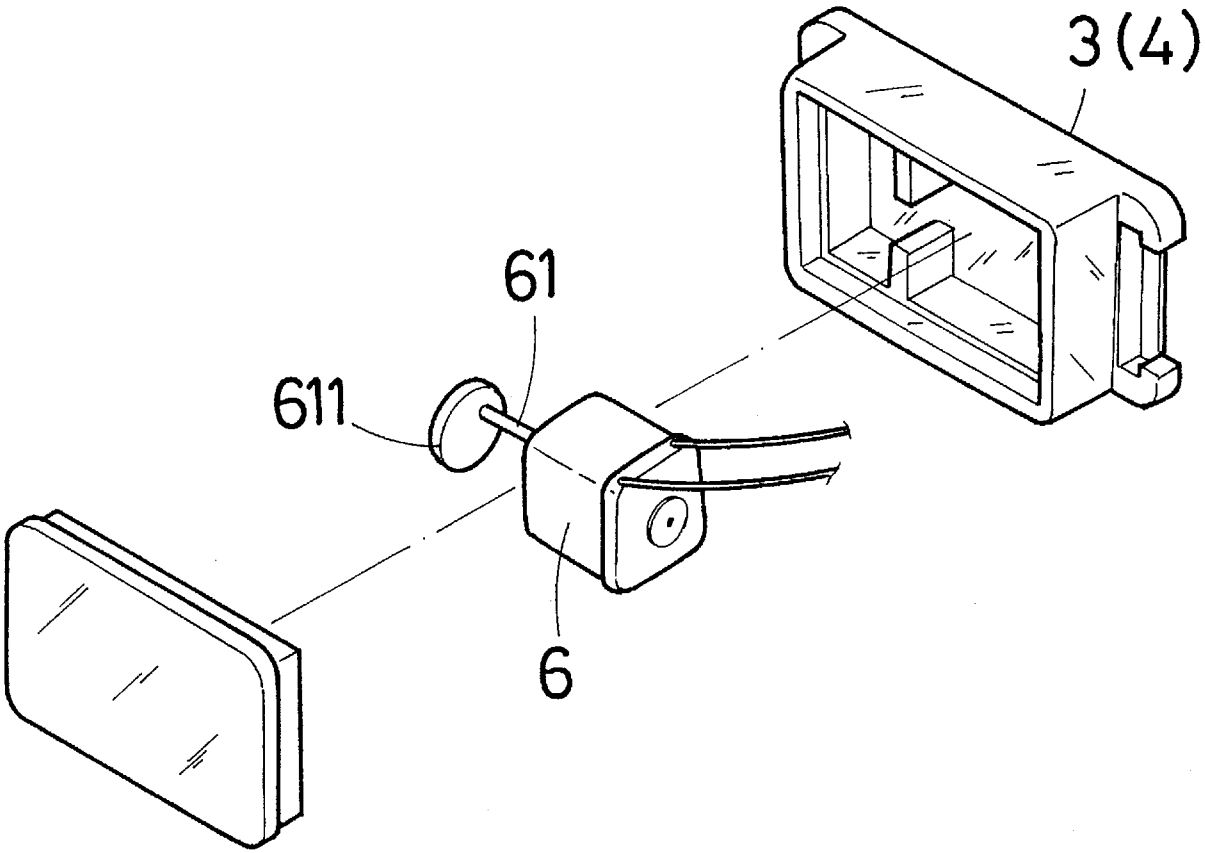
FIG. 4 is an exploded view of the oscillating device.

Referring to FIG. 4, the oscillating devices 3 and 4 each include a casing in which are mounted a motor 6 and an eccentric disc 611 arranged on an output shaft 61 of the motor 6. Hence, the oscillating devices 3 and 4 will oscillate when the motors 6 are turned on. Further, the motors 6 are connected with the control switch 21 mounted on the second flexible headband section 2 so that the speed of the output speed of motors 6 can be adjusted by the control switch 21.

Figure 5:
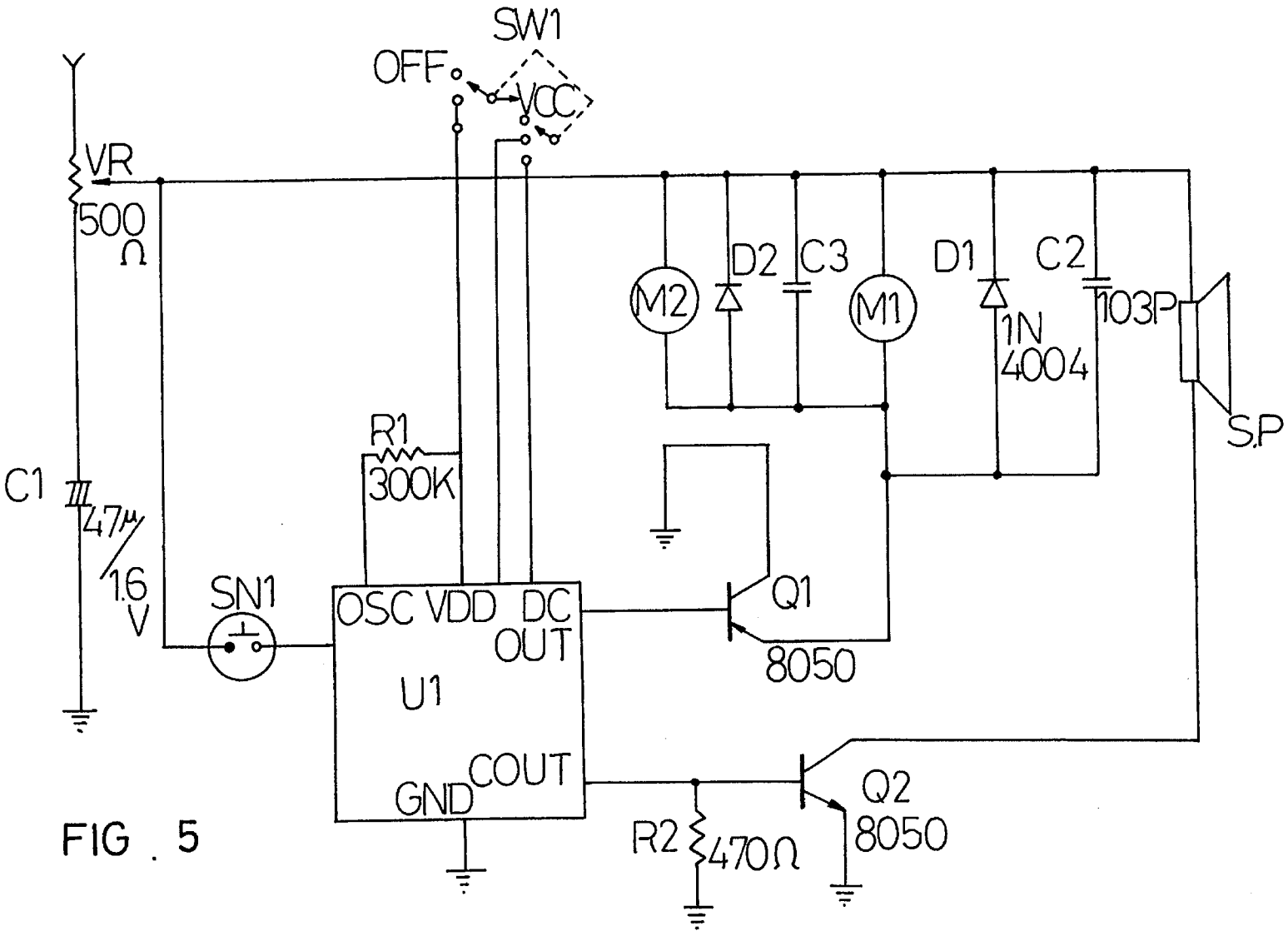
FIG. 5 is a circuit diagram of the wakening device.

The circuit diagram of the printed circuit board 53 is shown in FIG. 5. As illustrated, when the balance switch SN1 is conducted, an integrated circuit U1 will output a voltage signal which will be amplified by a transistor Q1 for driving the motors M1 and M2. The diodes D1 and D2 and the capacitors C2 and C3 connected in parallel to the motors M1 and M2 are used for filtering disturbing signals. In the meantime, the voice signal stored in the integrated circuit U1 will be amplified by the transistor Q2 thereby causing the loudspeaker to produce voice. The integrated circuit U1 is connected with a double-pole triple-throw switch SW1 so that when the switch SW1 is switched to the intermediate position, the motors M1 and M2 will be turned on but the loudspeaker will not send out voice signal. As the switch SW1 is switched to the third throw, the motors M1 and M2 will be turned on and the loudspeaker will produce voice signal at the same time. Further, once the balance switch SN1 is turned on, the time that the motors M1 and M2 and the loudspeaker are actuated is controlled by the integrated circuit U1.

Figure 6:
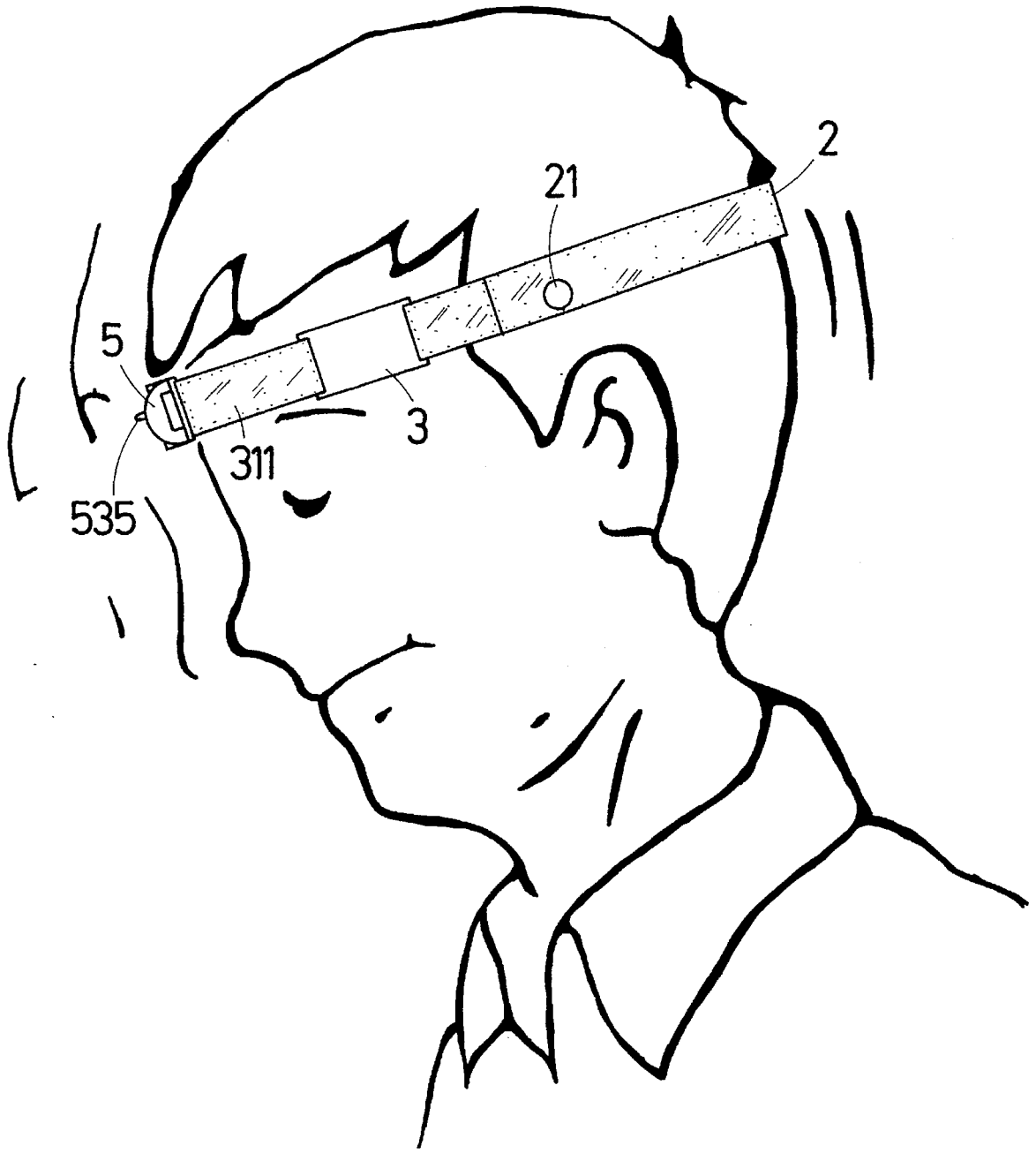
FIG. 6 is a working view of the present invention.

FIG. 6 is a working view of the present invention. As shown, when the user feels sleepy and nods off to a position where the inclined angle of the balance switch 532 exceeds the preset angle, the balance switch 532 will be turned on thereby triggering the wakening device 5 and therefore actuating the oscillating devices 3 and 4 to oscillate and causing the loudspeaker to send out warning signal.

Figure 7:
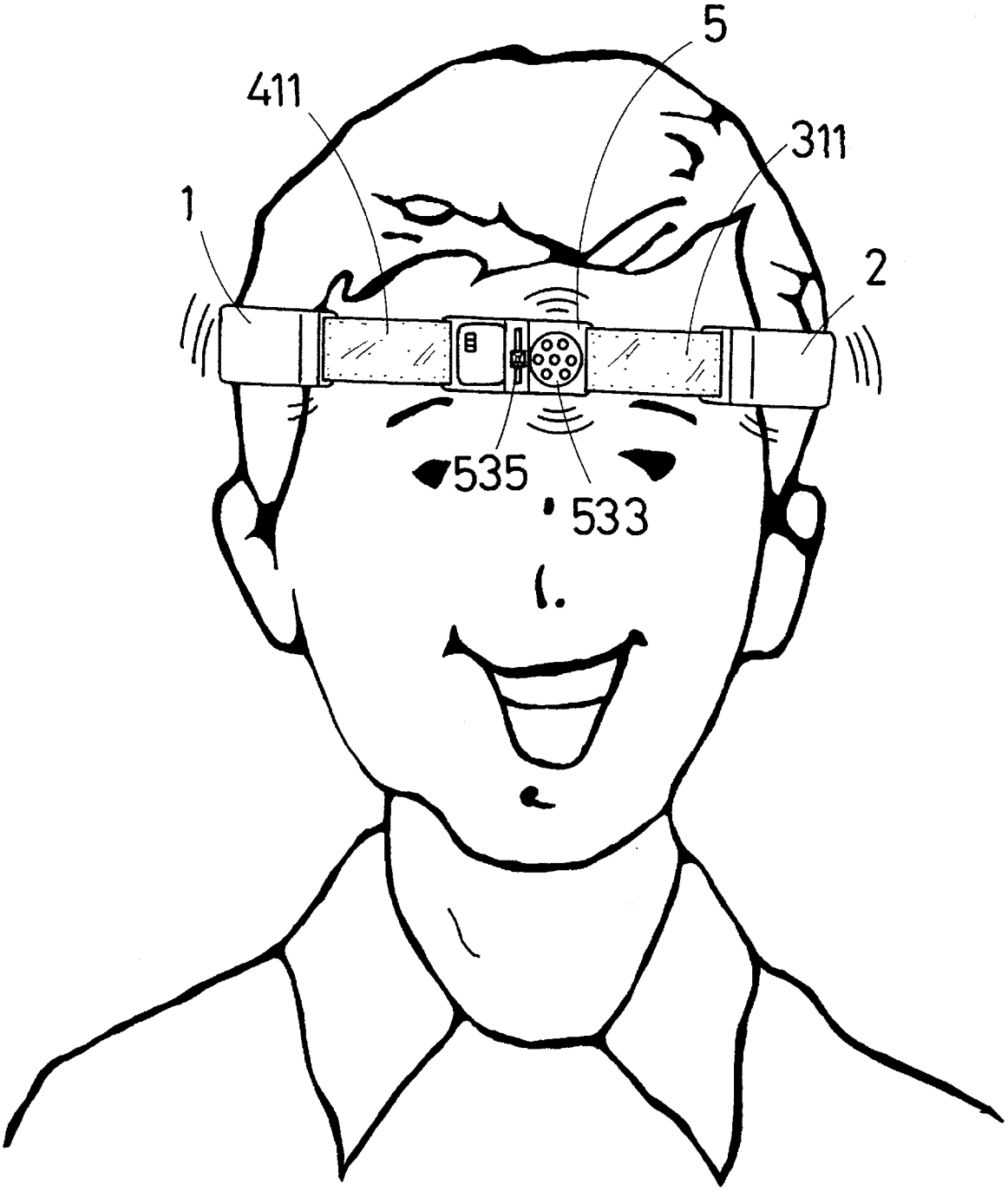
FIG. 7 illustrates another application of the present invention.

FIG. 7 illustrates another application of the present invention. The user may turn the switch SW1 to actuate the motors 6 to oscillate hence massaging his head when he feels tired.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A wake-up device comprising:

a first flexible headband section formed with battery chamber;

a second flexible headband section;

first oscillating means connected with an end of said first flexible headband section;

second oscillating means connected with an end of said second flexible headband section;

a first connector connected with said first oscillating means;

a second connector connected with said second oscillating means;

wakening means mounted between said first and second connectors, said wakening means including abalance switch, an electronic circuit connected with said balance switch, and a loudspeaker connected with said electronic circuit.

2. The wake-up device as claimed in claim 1, wherein said wakening means includes a housing having a pair of curved plates each formed with a plurality of ribs, and adjusting rod fitted between said curved plates and having two protuberances one at a side thereof adapted to engage between said ribs.

3. The wake-up device as claimed in claim 1, wherein said second flexible headband section is provided With a control switch for controlling oscillation intensity of said first and second oscillating mean.

* * * * *